United States Patent [19]

Poling

[11] Patent Number: 4,865,156

[45] Date of Patent: Sep. 12, 1989

[54] OIL CHANGE DEVICE AND METHOD

[76] Inventor: Denzil C. Poling, Rte. 6, P.O. Box 80, Hagerstown, Md. 21740

[21] Appl. No.: 203,314

[22] Filed: Jun. 7, 1988

Related U.S. Application Data

[62] Division of Ser. No. 915,081, Oct. 3, 1986, Pat. No. 4,776,431.

[51] Int. Cl.[4] ..... F16M 13/02

[52] U.S. Cl. ..... 184/1.5; 123/196 R; 141/26; 210/416.5

[58] Field of Search ..... 184/1.5, 103.1, 106; 123/196 R, 196 A; 222/83, 87; 194/904; 141/26, 23, 330, 8; 210/416.5, 251

[56] References Cited

U.S. PATENT DOCUMENTS

| | | | |
|---|---|---|---|
| 1,668,245 | 5/1928 | McGowan | 184/1.5 |
| 1,686,749 | 10/1928 | Higgins et al. | 184/1.5 |
| 2,746,330 | 5/1956 | Pfetzing | 81/53 |
| 3,908,797 | 9/1975 | Schnepp | 184/1.5 |
| 3,967,697 | 7/1976 | Guenther | 184/1.5 |
| 3,991,854 | 11/1976 | Tilley | 184/1.5 |
| 4,098,398 | 7/1978 | Meyers | 206/223 |
| 4,101,000 | 7/1978 | Scully | 184/1.5 |
| 4,128,140 | 12/1978 | Riches | 184/1.5 |
| 4,177,529 | 12/1979 | Sikula, Jr. | 141/330 |
| 4,230,002 | 10/1980 | Skidmore | 81/121 |
| 4,283,032 | 8/1981 | Smith | 248/97 |
| 4,289,255 | 9/1981 | Strampe | 141/330 |
| 4,376,703 | 3/1983 | Krauss | 220/85 H |
| 4,592,448 | 6/1986 | Morris | 184/1.5 |
| 4,676,281 | 6/1987 | Nord | 184/1.5 |

*Primary Examiner*—Carlton R. Croyle
*Assistant Examiner*—Robert N. Blackmon
*Attorney, Agent, or Firm*—Bernard, Rothwell & Brown

[57] ABSTRACT

Method and apparatus for changing oil in an internal combustion engine pierces an outer wall of an old oil filter containing old motor oil to form an opening in a lower portion of the filter wall. Old motor oil is drawn from the pierced oil filter into a container by suction through the filter wall opening and a suction conduit. The oil drain plug from a crankcase containing old motor oil is removed to form a drain opening in the crankcase, and old motor oil is drawn from the crankcase into a container by suction through the drain opening and a suction cup, to empty the crankcase of old motor oil. The drain opening is closed after emptying the crankcase of old motor oil by securing the drain plug in the drain opening. The pierced and drained old oil filter is replaced with a new filter and the drained crankcase is refilled with fresh motor oil.

6 Claims, 5 Drawing Sheets

OIL CHANGE DEVICE AND METHOD

This is a division of application Ser. No. 915,081, filed Oct. 3, 1986, now U.S. Pat. No. 4,776,431.

BACKGROUND OF THE INVENTION

1. Field of the Invention

The present invention relates to a method and apparatus for changing motor oil in an internal combustion engine.

2. Description of the Background Art

Replacement of oil in a motor vehicle typically involves placing a catch basin below the vehicle, removing the drain plug from the crankcase and allowing the oil to flow by gravity into the catch basin. The oil filter then is removed, which generally results in some oil spillage due to the filter being filled with oil. Horizontally positioned oil filters are especially difficult to remove without oil spillage onto adjacent vehicle components, since oil begins to drain from the filter before unthreading of the filter is complete.

Spillage also occurs with vertically placed oil filters which leak oil trapped in the dome when unthreaded. The filters are commonly positioned above other vehicle parts, compelling the mechanic to tilt the filter and thereby spill oil. Furthermore, changing oil at high engine operating temperature as is currently advocated by many, involves handling an extremely hot filter due to the high temperature of the oil present therein. Vehicular parts positioned in the path of filter removal exacerbates removal of a hot filter, often causing the mechanic to drop the filter in order to avoid burned fingers.

A wide variety of devices have been proposed to assist in changing motor oil. For example, expired U.S. Pat. No. 1,668,245 to McGowan discloses a rotating crankcase drain funnel including a drain hose and a socket for removing the drain plug.

Expired U.S. Pat. No. 1,686,749 to Higgins et al. discloses an oil catch basin with a geared drain plug-removing wrench mounted thereon.

Expired U.S. Pat. No. 2,746,330 to Pfetzing discloses a unitary wrench and container for removing an oil filter including an oil-catching cup, a rotatable socket and a handle for rotating the socket.

U.S. Pat. No. 3,967,697 to Guenther discloses a crankcase oil drainage and collection device which requires a special drain plug having a passageway therein such that on partial removal of the plug, oil can drain from the crankcase into a funnel which directs the oil into an oil container.

U.S. Pat. No. 4,230,002 to Skidmore discloses a device for removing a plug and draining oil from a vehicle oil pan including a socket for removing the drain plug, a funnel for catching draining oil and an oil drain hose.

U.S. Pat. No. 4,592,448 to Morris discloses an oil pan drain receptacle including an oil-catching conduit for attachment to a crankcase by means of Velcro ® fasteners, a drain plug-removing wrench which is rotatable within the conduit, and a bag for collecting draining oil passing through the conduit.

Other devices for assisting replacement of motor oil in engines are disclosed in U.S. Pat. Nos. 4,098,398; 4,101,000 and 4,283,032.

A method for removing oil from an engine without removing the crankcase drain plug also is known. This method involves removing the dip stick of the engine and snaking a hose through the dip stick tube to remove oil from the engine by suction. This method has not been generally adopted due to the high likelihood of incomplete removal of dirty oil from the engine, particularly with crankcases having a well of oil below the level that can be reached by the suction tube. This method also leaves up to about a quart of dirty oil in the old oil filter if not replaced.

There remains a need in the art for methods and devices which facilitate efficient replacement of motor oil and oil filter of an engine while eliminating oil spillage during the operation.

SUMMARY OF THE INVENTION

In accordance with the present invention, an oil change device for changing motor oil in an internal combustion engine includes means for removing old motor oil from the old oil filter which comprises a suction conduit having a mouth and an exit passageway, and means for piercing an outer wall of an oil filter to form an opening in a lower portion of the filter wall. The exit passageway of the suction conduit is connected to a first flexible hose in communication with a source of suction, for applying suction to the suction conduit and thereby draw old motor oil from the oil filter through the filter wall opening and through the suction conduit into a container. The oil change device further includes means for removing old motor oil from an engine crankcase through a drain opening in the bottom of the crankcase. The crankcase oil removing means includes a suction cup having a mouth and an exit passageway. The exit passageway of the suction cup is connected to a second flexible hose in communication with the source of suction, for applying suction to the second suction cup and thereby drawing oil from the crankcase through the crankcase drain opening and through the suction cup into the container when the mouth of the suction cup is in sealing contact with the crankcase over the crankcase drain opening.

The invention further relates to a method for changing oil in an internal combustion engine, the method comprising piercing an outer wall of an old oil filter containing old motor oil to form an opening in a lower portion of the outer wall of the filter. Old motor oil is drawn from the pierced oil filter into a container by suction through the filter wall opening. The oil drain plug is removed from an engine crankcase containing old motor oil to form a drain opening in the crankcase. Old motor oil is drawn from the crankcase into a container by suction through the drain opening to empty the crankcase of old motor oil. The drain opening is closed after emptying the crankcase of old motor oil by securing the drain plug in the drain opening. The pierced and drained old oil filter is replaced with a new filter, and the drained crankcase is refilled with fresh motor oil after replacing the old filter and securing the drain plug in the drain opening.

DETAILED DESCRIPTION OF THE PREFERRED EMBODIMENTS

Figure 1:
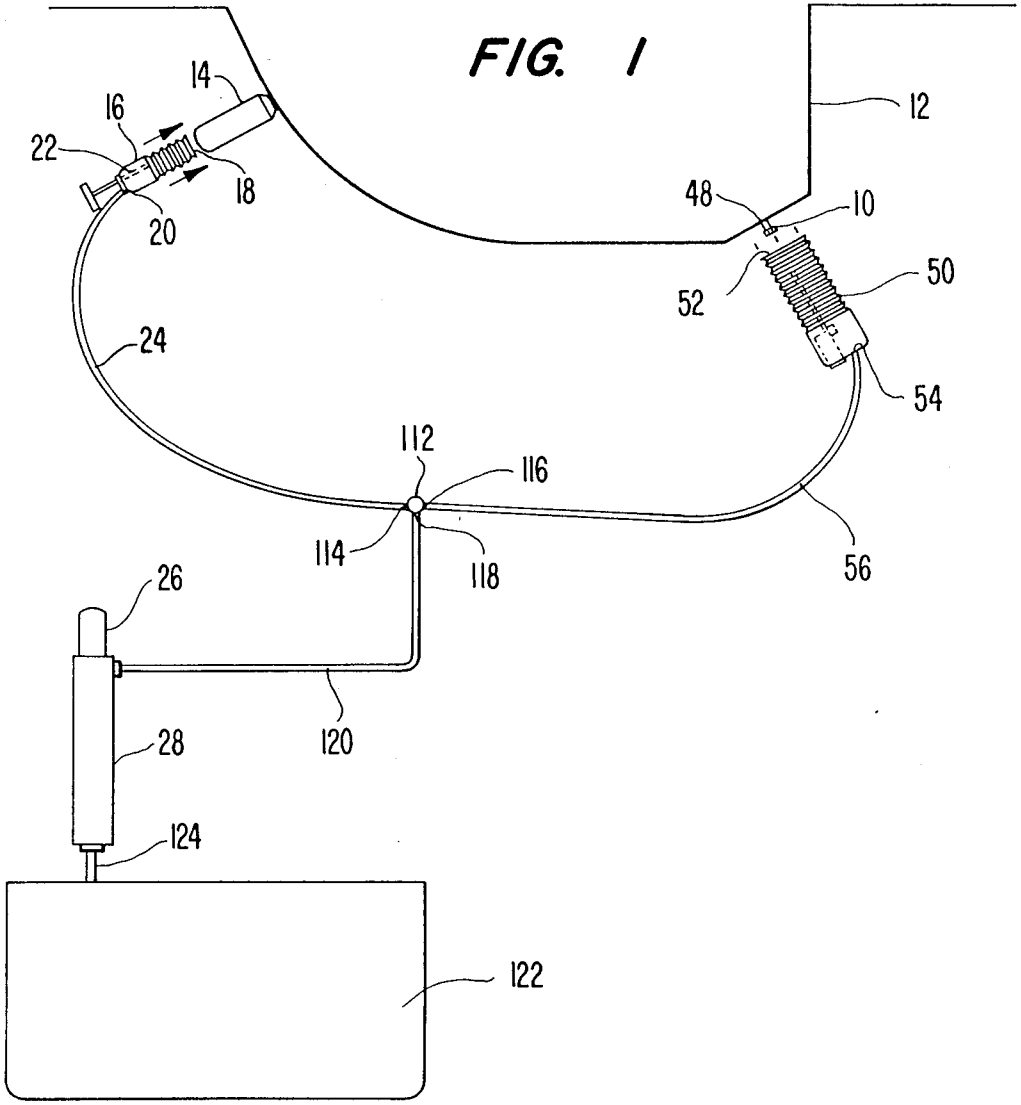
FIG. 1 schematically illustrates one embodiment of the invention in use.
Figure 2:
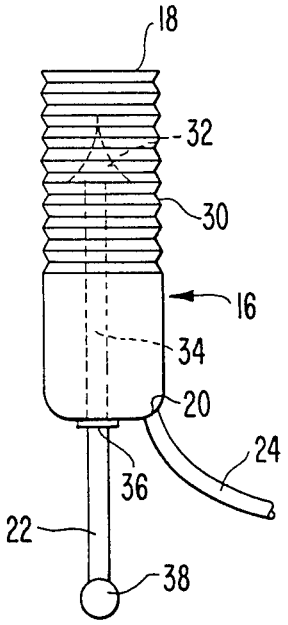
FIG. 2 is an elevational view, partly schematic, showing the oil filter oil removing device of FIG. 1.
Figure 3:
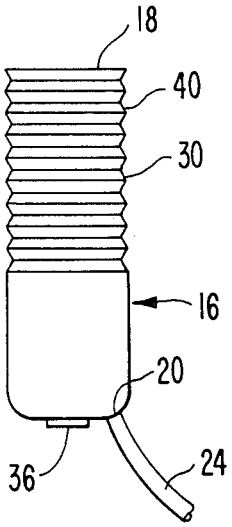
FIG. 3 is an elevational view, partly schematic, showing the suction cup of the device shown in FIG. 2.
Figure 4:
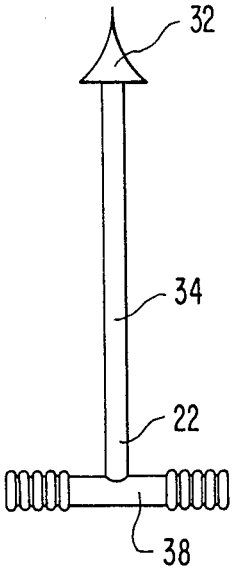
FIG. 4 is an elevational view, partly schematic, showing the filter wall piercing spear of the device shown in FIG. 2.

With reference to FIG. 1, an oil change device according to the present invention is for changing motor oil in the internal combustion engine having an oil drain plug 10 in an engine crankcase 12, and a replaceable oil filter 14.

A device according to the invention includes means for removing old motor oil from the oil filter 14, which includes a suction conduit 16 having a mouth 18 and an exit passageway 20.

Means for provided for piercing an outer wall of the oil filter 14, the piercing means 22 being capable of forming an opening in the filter wall.

The exit passageway 20 of the suction conduit is connected to a first flexible hose 24 in communication with a source of suction, such as vacuum motor 26. Other suitable sources of suction, such as a vacuum transducer, can be used. Vacuum motor 26 applies suction to the suction conduit 16 to draw oil from the oil filter 14 through the filter wall opening and through the suction conduit 16 into a container 28.

In accordance with one embodiment, suction conduit 16 is comprised of a suction cup 30. See FIGS. 1–4. In accordance with this embodiment the mouth 18 of suction cup 30 is placed in sealing contact with the wall of oil filter 14 over the pierced filter wall opening, for applying suction to remove oil from filter 14. In the embodiment shown in FIGS. 1–4, suction cup 30 includes a cup body portion having a wall portion formed as a longitudinally displaceable resilient bellows 40 for bringing mouth 18 into sealing contact with oil filter 14.

According to this embodiment, the filter wall piercing means 22 is comprised of a spear, which may be slidably displaceable within the suction cup 30. The spear includes a spearhead 32 for piercing the filter wall in the vicinity of mouth 18 of the suction cup 30. The spear further includes a spear shaft 34 connected to spearhead 32 and extending from spearhead 32 through an inside portion of the suction cup 30 and through an aperture 36 in a wall portion of the suction cup 30 to a spear handle 38 connected to the spear shaft 34 outside the suction cup 30. Spear shaft 34 makes sealing contact with aperture 36, and may be longitudinally slidable within aperture 36 or alternatively fixed within aperture 36. Spearhead 32 may be twisted within the filter element to become temporarily lodged in the filter element, thereby providing means for holding the mouth 18 of suction cup 30 in sealing contact with the wall of filter 14 during suction of oil from the filter.

Figure 6:
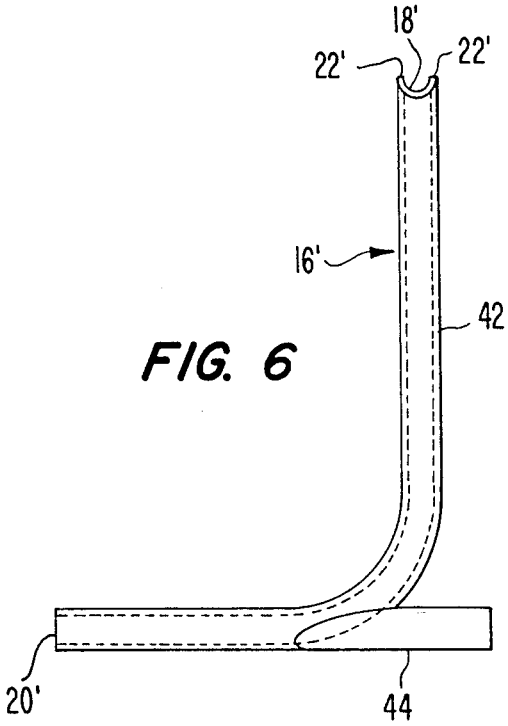
FIG. 6 is a side elevational view, partly schematic, showing another embodiment for removing old motor oil from an oil filter.

According to another embodiment, the oil filter oil-removing means includes a suction conduit 16′ comprised of a rigid tube 42. See FIG. 6. In accordance with this embodiment, the mouth 18′ is sharpened to form piercing means 22′ thereon. The device shown in FIG. 6 includes a hammer point 44 for driving tube 42 into vertically positioned oil filters for suction extraction of oil through passageway 20′ connected to a suitable source of suction by a flexible hose.

Figure 5:
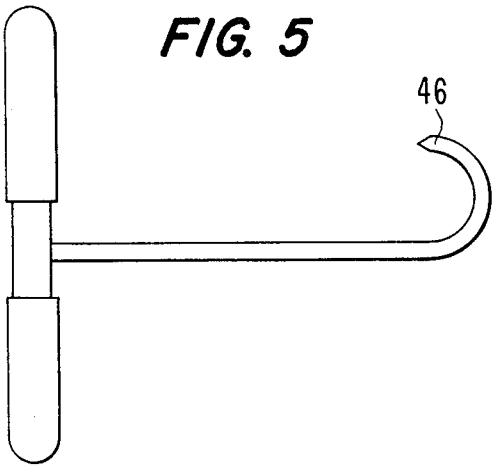
FIG. 5 is a side elevational view, partly schematic, of a sharpened steel hook for forming an air opening in an oil filter.

For very rapid removal of oil from an oil filter by suction, a sharpened hook 46 may be used to pierce an upper portion of an oil filter to admit air into the oil filter during suction and facilitate quick removal of oil. See FIG. 5. A detergent solution may be admitted into this air hole to further remove old oil cohesively trapped in the filter element, if desired.

Referring back to FIG. 1, an oil change device according to the invention further includes means for removing old motor oil from an engine crankcase 12 through a drain opening 48 in the crankcase upon removal of crankcase drain plug 10. The means for removing oil from a crankcase includes a suction cup 50 having a mouth 52 and an exit passageway 54. The exit passageway 54 of suction cup 50 is connected to a second flexible hose 56 in communication with a source of suction such as vacuum motor 26, or other suitable suction means such as vacuum transducer. Vacuum motor 26 applies suction to suction cup 50 to thereby rapidly draw oil from the crankcase through the crankcase drain opening 48 and through suction cup 50 into container 28 when the mouth 52 of the suction cup 50 is in sealing contact with crankcase 12 over drain opening 48. Suction removal of old motor oil from the engine is facilitated by uncapping the opening through which new motor oil is introduced into the engine, generally located in a valve cover.

Figure 7:
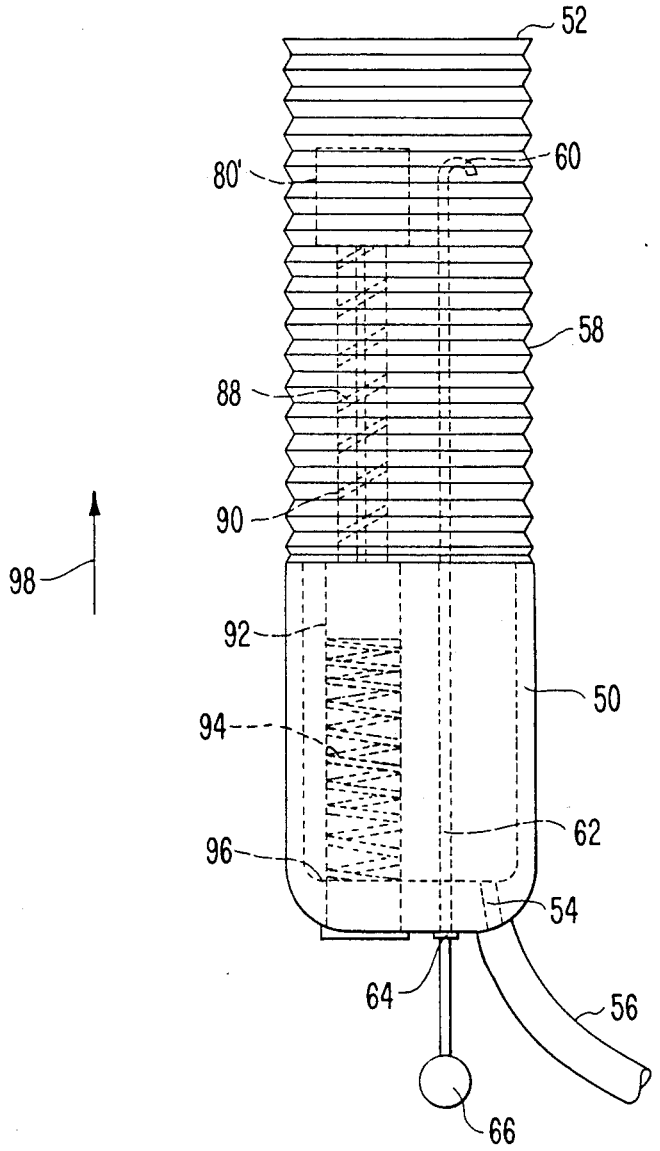
FIG. 7 is a side elevational view, partly schematic, showing one embodiment for removing a drain plug and old motor oil from a crankcase.

With reference to FIG. 7, suction cup 50 includes a body portion having a wall portion formed as a longitudinally displaceable resilient bellows 58 for bringing the mouth 52 of suction cup 50 into sealing contact with the crankcase over the crankcase drain opening for suction removal of oil from the crankcase.

In the embodiment shown in FIG. 7, a hook 60 is provided for holding the mouth 52 of the suction cup 50 in sealing contact with a crankcase over the drain opening. Hook 60 includes a shaft 62 which makes sealing contact with an aperture 64 in suction cup 50. The hook is maneuvered by means of a handle 66, and shaft 62 may be longitudinally slidable within aperture 64 for positioning hook 60 inside a crankcase drain opening to hook an inside portion of the crankcase and thereby hold the mouth 52 of suction cup 50 in sealing contact with the crankcase over the crankcase drain opening.

Figure 8:
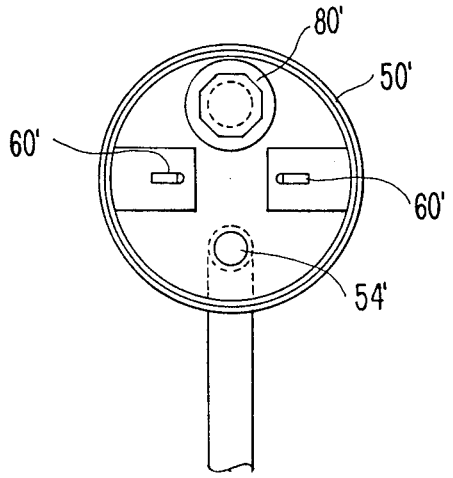
FIG. 8 is a top elevation view, partly schematic, of another embodiment for removing a drain plug and old motor oil from a crankcase.

In another embodiment, flexible rubber cup 50′ is squeezable to displace a pair of hooks 60′ for insertion into and retraction from a drain opening to hold the mouth of the suction cup in sealing contact with the crankcase. See FIG. 8.

Figure 11:
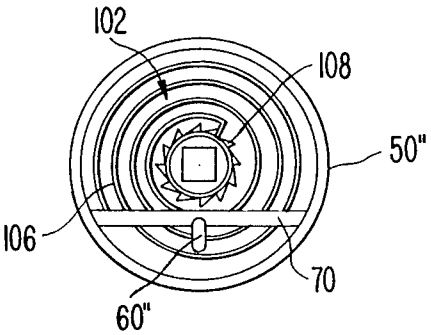
FIG. 11 is a top elevation view, partly schematic, of the embodiment shown in FIGS. 9 and 10.
Figure 10:
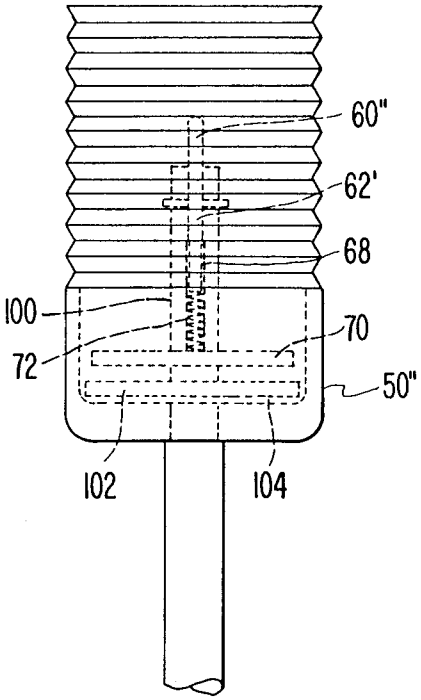
FIG. 10 is a side elevation view, partly schematic, taken at 90° of the view shown in FIG. 9.
Figure 9:
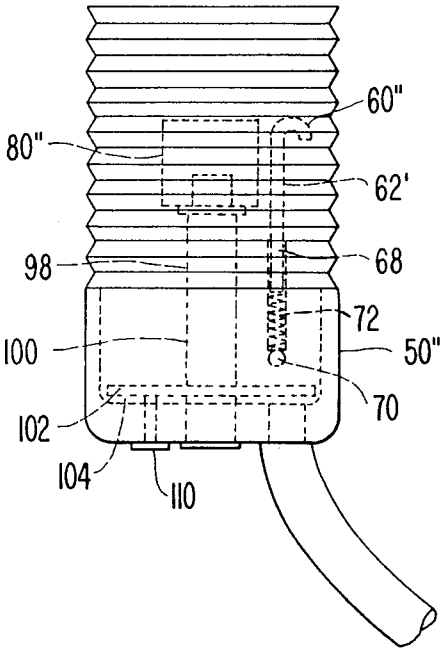
FIG. 9 is a side elevation view, partly schematic, of yet another embodiment for removing a drain plug and old motor oil from a crankcase.

In yet another embodiment shown in FIGS. 9–11, drain hook 60″ is attached to shaft 62′ which is longitudinally displaceable within a tube 68 fixed to the sides of suction cup 50″ by means of cross member 70. Upwardly biased spring 72 provides for reciprocating movement of shaft 62' within tube 68.

Several embodiments of the invention include means for removing a threaded crankcase oil drain plug 10 from the crankcase drain opening 48 with the mouth 52 of cup 50 in position to catch oil draining from crankcase drain open 48 upon removal of plug 10.

Figure 12:
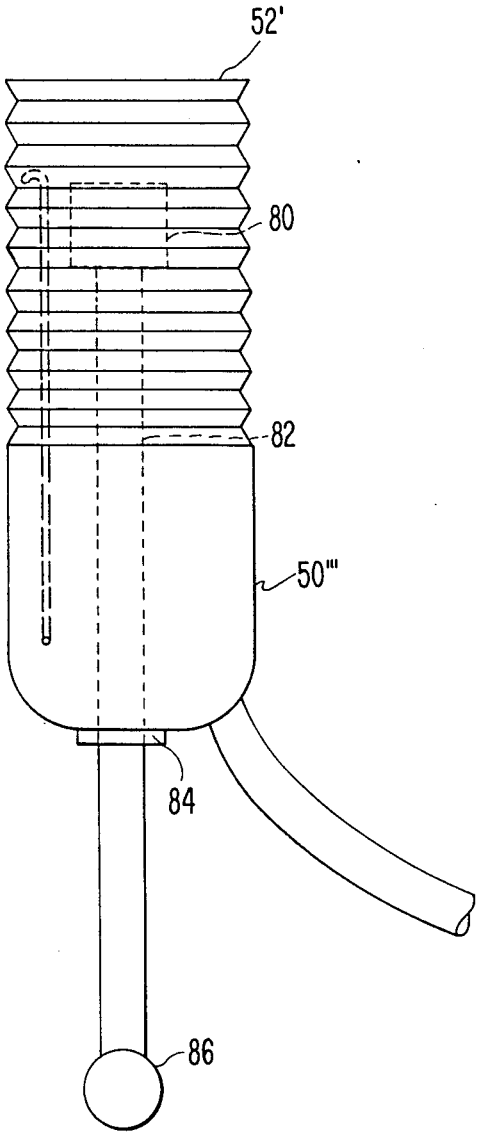
FIG. 12 is a side elevation view, partly schematic, of another embodiment for removing a drain plug and old motor oil from a crankcase.

In accordance with one embodiment, the drain plug removing means comprises a wrench socket 80'' shaped to mate with and turn a complementary head of a drain plug. See FIG. 12. A wrench shaft 82 is connected to the wrench socket 80 and extends from wrench socket 80 through an inside portion of the suction cup 40''' and through an aperture 84 in a wall portion of suction cup 50''' to a wrench handle 86 connected to the wrench shaft 82 outside suction cup 50'''. Wrench shaft 82 is rotatable and longitudinally displaceable within cup aperture 84 to place the wrench socket 80 in the vicinity of the mouth 52' of cup 50''', with wrench shaft 82 making sealing contact with aperture 84.

In another embodiment, the drain plug removing means comprises a longitudinally collapsible, spiral shaft, push-drive ratchet wrench 88. See FIG. 7. Ratchet wrench 88 includes a wrench socket 80' shaped to mate with and turn a complementary head of a drain plug, socket 80' being positionable to engage the plug head in the vicinity of the mouth 52 of cup 50. Socket 80' is connected to one end of a push ratchet drive longitudinally collapsible spiral shaft 90, spiral shaft 90 including a receiving member 92 and a spring 94 biased toward socket 80'. Spiral shaft 90 is connected to an inside bottom portion 96 of cup 50, such that pushing cup 50 in the direction shown by arrow 98 (towards a crankcase drain plug), with the wrench socket mated with a drain plug head, collapses spiral shaft 90 and rotates socket 80'. Several quick pushes will remove a drain plug mated with socket 80' to remove the drain plug from a crankcase drain opening. The longitudinally collapsible spiral shaft push-drive ratchet wrench 88 operates in the manner of a typical "ratcheting screwdriver" well known in the art.

In the embodiment shown in FIGS. 9–11, the drain plug-removing means comprises a windable, spring-driven, rotating socket wrench 98. Wrench 98 includes a wrench socket 80'' shaped to mate with and turn a complementary head of a drain plug, the wrench socket being positioned to engage the plug head in the vicinity of the mouth of the cup 50'' and being connected to one end of a wrench shaft 100. The other end of wrench shaft 100 is connected to a windable spring drive 102 mounted on an inside bottom portion 104 of cup 50''. Windable spring drive 102 includes a spring 106 capable of being wound and locked by means of a toothed catch 108. A button 110 outside of cup 50'' is connected to the toothed catch 108 for releasing the wound spring 106 and rotating socket 80'. Pressing release button 110 releases wound spring 106 with socket 80'' engaged with a plug head to rotate the socket 80'' with the drain plug and remove the drain plug from a crankcase drain opening.

If necessary, plug 10 can be loosened using a conventional wrench prior to removal of the plug using one of the above-described plug-removing devices.

In the embodiment shown in FIG. 1, the oil change device of the present invention includes a diverter valve 112 having two inlets 114 and 116 and an outlet 118. Flexible hose 24 is connected to valve inlet 114, flexible hose 56 is connected to valve inlet 116, and valve outlet 118 is connected to container 28 by means of line 120. Operation of valve 112 shifts communication between the container 28 and either hose 24 or hose 56 to the exclusion of the other.

Advantageously, the oil change of the device of the invention includes a large holding tank 122 for holding and storing old oil having a significantly greater volume than container 28. In the embodiment shown, container 28 is in communication with holding tank 122 by means of a one-way check valve 124 permitting flow of oil from container 28 to the holding tank, but prohibiting flow of fluid, such as air, from the holding tank 122 to container 28. Check valve 124 eliminates the need to evacuate air from large holding tank 122 to achieve vacuum during each use.

The present invention provides a quick and clean method for removing old oil from an oil filter and engine crankcase. In accordance with the method of this invention, an outer wall of an old oil filter 14 containing old motor oil is pierced to form an opening in a lower portion of the outer wall, such as by means of spear 22. If desired, an air hole is formed in an upper portion of the filter wall by hook 46 to facilitate removal of oil from the filter. Old motor oil is drawn from the pierced oil filter into container 28 by suction from vacuum motor 26 through the filter wall opening, and through flexible hose 24, valve 112 and line 120.

The oil drain plug 10 is removed from an engine crankcase containing old motor oil, using any of the above-described drain plug removing means, or other suitable means such as a conventional wrench, to form a drain opening 48 in the crankcase 12. Old motor oil is drawn from crankcase 12 into container 28 by suction applied by vacuum motor 26 after shifting valve 112, the oil being drawn through drain opening 48, suction cup 50, line 56, valve inlet 116 of valve 112, and line 120, to empty the crankcase of old motor oil. Suction cup 50 is removed and drain opening 48 is closed after emptying the crankcase of old motor oil using any suitable means, such as a conventional wrench, to secure the drain plug in the drain opening. Advantageously, suction cup 50 is hung in an upright position to avoid drippage of oil.

Suction conduit 16 may be removed by twisting and pulling spear 22 from the oil filter. Upon removal of suction conduit 16, which may be thereafter hung in an upright position to avoid oil drippage, the oil filter may easily be removed and handled due to the cool thin walls of the filter after oil removal.

The pierced and drained oil filter then is replaced with a new oil filter, and the drained crankcase is refilled with fresh motor oil after replacing the old oil filter and securing the drain plug in the drain opening.

When vacuum motor 26 is turned off, oil flows from container 28 into holding tank 122 through check valve 124.

Utilization of an oil change device according to the present invention provides for removal of oil filter, drain plug and old oil of a typical motor vehicle, including replacement of a new filter, in a matter of several minutes or less, without spillage. Moreover, rapid suction removal of old oil provides a swirling, whirlpool action in the crankcase which removes undesirable sediments and the like, which otherwise would remain in the crankcase to contaminate the new oil.

Since many modifications, variations and changes in detail may be made to the above-described embodiments, it is intended that all matter in the foregoing description and shown in the accompanying drawings be interpreted as illustrative and not in a limiting sense.

What is claimed is:

1. An oil change device for changing motor oil in an internal combustion engine having a replaceable oil filter, the device comprising:

means for removing oil from the oil filter including a suction conduit having a mouth and an exit passageway, and means for piercing an outer wall of an oil filter to form an opening in the filter wall; the exit passageway of the suction conduit being connected to a hose in communication with a source of suction for applying suction to the suction conduit and thereby draw oil from the oil filter through the filter wall opening and through the suction conduit into a container; said suction conduit being comprised of a suction cup having a wall portion which is longitudinally displaceable and resilient, wherein the mouth of the suction cap is sized so as to enable the mouth of the suction cup to be placed in sealing contact with the wall of the oil filter over the pierced filter wall opening for applying suction to remove oil from the filter.

2. The device of claim 1 further including another suction conduit comprised of a rigid tube having a mouth that is sharpened to form a means for piercing an outer wall of a oil filter to form an opening in the filter wall, said another suction conduit being connectable to said source of suction for drawing oil from the oil filter.

3. The device of claim 1 wherein the means for piercing the filter wall includes means for holding the mouth of the suction cup in sealing contact with the wall of the filter during suction of oil from the filter.

4. The device of claim 5 wherein the means for piercing the filter wall comprises a spear having a spearhead for piercing the filter wall in the vicinity of the mouth of the suction cup, a spear shaft connected to the spearhead and extending from the spearhead through an inside portion of the suction cup and through an aperture in a wall portion of the second cup to a spear handle connected to the spear shaft outside the suction cup, the spear shaft making sealing contact with said suction cup aperture.

5. The device of claim 1 including means external of the suction cup for piercing the wall of the oil filter.

6. The device of claim 1 further including an old oil holding tank of greater volume than said container, said container being connected to the holding tank by means of a one-way check valve permitting flow of oil from the container to the holding tank but prohibiting flow of fluid from the holding tank to the container.

* * * * *

UNITED STATES PATENT AND TRADEMARK OFFICE

CERTIFICATE OF CORRECTION

PATENT NO. : 4,865,156

DATED : September 12, 1989

INVENTOR(S) : Denzil C. Poling

It is certified that error appears in the above-identified patent and that said Letters Patent is hereby corrected as shown below:

Front Page, Column 1, [54], delete "AND METHOD".

Column 1, Line 1, delete "AND METHOD".

Column 3, Line 28, delete "the" and substitute therefor --an--

Column 3, Line 35, delete "for" and substitute therefore --are--

Column 3, Line 48, after "embodiment" insert --,--.

Column 5, Line 13, delete "40'''" and substitute therefor --50'''--.

Column 7, Line 19, delete "cap" and substitute therefor -- cup--.

Column 8, Line 14, Delete "second" and substitute therefor --suction--.

Signed and Sealed this

Twenty-eighth Day of May, 1991

*Attest:*

HARRY F. MANBECK, JR.

*Attesting Officer*

*Commissioner of Patents and Trademarks*